US006441743B1

(12) United States Patent
Berger

(10) Patent No.: US 6,441,743 B1
(45) Date of Patent: Aug. 27, 2002

(54) METHOD AND APPARATUS FOR DETERMINING HAZARD LEVELS OF CHEMICAL/BIOLOGICAL/NUCLEAR AGENTS IN AN ENVIRONMENT

(75) Inventor: Eugene L. Berger, San Antonio, TX (US)

(73) Assignee: The Mitre Corporation, McLean, VA (US)

( * ) Notice: Subject to any disclaimer, the term of this patent is extended or adjusted under 35 U.S.C. 154(b) by 0 days.

(21) Appl. No.: 09/698,109

(22) Filed: Oct. 30, 2000

(51) Int. Cl.[7] ..... G08B 21/00

(52) U.S. Cl. ..... 340/603; 340/632; 73/23.2

(58) Field of Search ..... 340/628, 632, 340/603, 633, 634, 629, 630; 73/23.2, 23.31, 23.3, 23.41

(56) References Cited

U.S. PATENT DOCUMENTS

| | | | | | |
|---|---|---|---|---|---|
| 4,644,331 | A | * | 2/1987 | Matsushita et al. | 340/587 |
| 4,796,205 | A | * | 1/1989 | Ishii | 340/628 |
| 5,049,861 | A | * | 9/1991 | Grace | 340/632 |
| 5,966,079 | A | * | 10/1999 | Tanguay | 340/636 |
| 5,969,623 | A | * | 10/1999 | Fleury et al. | 340/632 |

* cited by examiner

*Primary Examiner*—Anh N. La
(74) *Attorney, Agent, or Firm*—Rosenberg, Klein & Lee

(57) ABSTRACT

A system and method for determining hazard levels of chemical, biological, and nuclear agent in an environment processes chemical vapor concentration measurements and generates hazard levels of the chemical vapor. The system and method provide an estimate of hazard level values by using an exponentially weighted moving integration of the vapor concentrations. When the estimated hazard level values match or exceed empirically predetermined hazard accumulated dosage values for a particular chemical, biological, or nuclear agent, an indication of the level of hazard is generated.

6 Claims, 5 Drawing Sheets

METHOD AND APPARATUS FOR DETERMINING HAZARD LEVELS OF CHEMICAL/BIOLOGICAL/NUCLEAR AGENTS IN AN ENVIRONMENT

FIELD OF THE INVENTION

The present invention relates to a system and method for calculation of hazard levels of chemical/biological/nuclear agents in an environment, and more particularly to a method developed to generate hazard level indication in detectors of chemical, biological, or nuclear agents.

More in particular, the present invention relates to a technique developed to indicate the accumulated dosage that is hazardous to humans or other living organisms which estimates hazard level values by applying an exponentially weighted moving integration to measure the concentrations of the chemical/biological/nuclear agent in the environment. The system generates an indication of the level of hazard when the estimated hazard level values match or exceed empirically predetermined hazard dosage values for the agent in question.

BACKGROUND OF THE INVENTION

Medical problems experienced by Armed Forces personnel has created a need to understand and provide warning when the level of accumulated dosage of a chemical, biological or nuclear agent reaches or exceeds the dosage level which would be harmful to the personnel exposed to the agent in question for a certain periods of time. Knowing the level of hazards for chemical/biological/nuclear agents would allow military commanders to change or adjust their operating procedures in order to prevent the personnel from exposure to harmful dosages of dangerous agents. There are no known algorithms that address the question of how to indicate the accumulated dosage of a chemical/biological/nuclear agent that may be hazardous to humans or other living organisms.

SUMMARY OF THE INVENTION

It is an object of the present invention to provide a technique of determining hazard levels of chemical/biological/nuclear agents in an environment and which warns a user when the accumulated dosage reaches or exceeds a hazard level.

It is another object of the present invention to provide an algorithm applicable to chemical, biological and nuclear detectors which would calculate accumulated dosage of an agent accumulated over a period of time, estimate hazard level values by applying an exponentially weighted moving integration to the measured concentrations of the detected chemical/biological/nuclear agent, and generate an indication of level of hazard when the estimated hazard level values match or exceed certain predetermined hazard dosage values determined empirically as harmful for the health of living organisms exposed to the agent in question.

The technique as herein described is directed to determining hazard levels and warning the users when the accumulated dosage of the chemical, biological or nuclear agent reaches the hazard levels and is envisioned to be applicable to any type of chemical, biological, or nuclear agent. According to the teaching of the present invention, a method of determining hazard levels of a vapor (chemical, nuclear, or biological agent) in an environment includes the steps of:

measuring concentrations of the agent in the environment;

estimating hazard level values of the agent by applying an exponentially weighted moving integration to the measured concentrations;

predetermining hazard dosage values defined empirically as harmful for living organisms;

comparing the estimated hazard level values to the predetermined hazard dosage values; and generating an indication of the level of hazard when the estimated hazard level values match or exceed the empirically predefined hazard dosage values of the agent.

Preferably, the hazard dosage values are predetermined as falling in three dosage ranges, i.e., a low hazard dosage value, a medium hazard dosage value, and a high hazard dosage value, which for each chemical, biological or nuclear agent are represented by a corresponding value.

Essentially, an algorithm developed as a core of the present invention processes chemical vapor concentration measurements and generates chemical vapor hazard levels. This algorithm provides an estimate of hazard level values by using an exponentially weighted moving integration (further referred to herein as EWMI) of chemical vapor concentrations.

EWMI has important advantages over a standard moving integration:

(A) EWMI reduces the storage required to keep a history of the chemical vapor concentrations to one value per chemical vapor type; and, (B) EWMI permits the automatic adjustment of the integration period and the decay rate for the accumulation of concentration as a function of the concentration level of the agent vapors.

The algorithm of the present invention uses EWMI to generate estimated detected agent hazard level values. When the EWMI calculated values match or exceeds the empirically set hazard levels the algorithm generates an indication of the level of the hazard.

The algorithm calculates the cumulative dosage according to the following equation:

$$D_i = D_{i-1} + in_i \cdot IST + D_0,$$

wherein $D_i$=the cumulative dosage at the $i^{th}$ sample, $D_{i-1}$=the dosage previous to the $i^{th}$ sample, $in_i$=the measured concentration at the $i^{th}$ sample, IST=the independent sample time, and $D_0$=the initial value of the dosage.

The estimated hazard level values are calculated by the algorithm of the present invention according to:

$$DI_i = DI_{i-1} + in_i \cdot IST - TR_i \cdot - DI_{i-1} \cdot IST$$

wherein $DI_i$=the exponentially weighted moving integral at the $i^{th}$ sample, $DI_{i-1}$=the exponentially weighted moving integral previous to the $i^{th}$ sample, $in_i$=the measured concentration at the $i^{th}$ sample, IST=the independent sample time, and $TR_i$=the $i^{th}$ decay rate.

The decay rate $TR_i$ is calculated by estimating the time period necessary for a measured concentration to reach a next higher predetermined hazard dosage value.

These and other novel features and advantages of this invention will be fully understood from the following detailed description of the accompanying Drawings.

DETAILED DESCRIPTION OF THE PREFERRED EMBODIMENT

Figure 1:
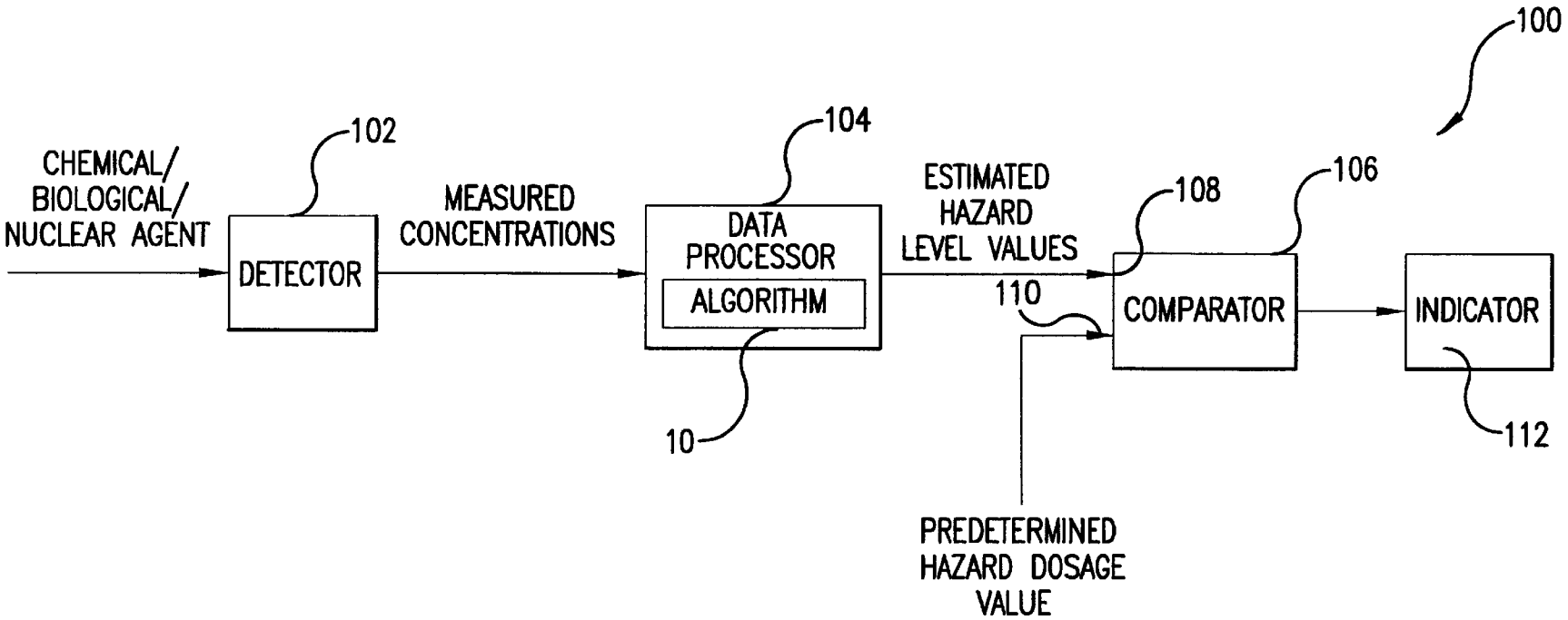
FIG. 1 shows schematically a block diagram of the apparatus of the present invention.

Referring to FIG. 1, showing a block diagram of the system and method of the present invention, the system 100 includes:

(a) a detector 102 for sensing and measuring concentrations of a chemical/biological/nuclear agent, (b) a data processor 104 running EWMI algorithm 10, processing data (measured concentrations) received from the detector 102, and outputting an estimated hazard level value, (c) a comparator 106 receiving said estimated hazard level value on one input 108 thereof and further receiving a predetermined hazard dosage value on another input 110 thereof, and comparing these values, and (d) an indicator 112 of level of hazard generating an indicia of the level of hazard once the estimated hazard level value reaches or exceeds the predetermined hazard dosage value.

As follows from the block diagram thereof, the system and the method of the present invention processes chemical vapor concentration measurements, and estimates hazard level values by using an exponentially weighted moving integration (EWMI) of the chemical vapor concentrations. When the EWMI-calculated values match or exceed the empirically set hazard levels, the system 100 generates an indication of the level of the hazard.

The data processor 104, as well as the comparator 106 may be embedded into the detector 102 thus constituting a self-contained miniature hazard detecting system, or alternatively, the algorithm 10 may be run on a distant computer to which data from the detector 102 are supplied through various communication means, and from which the results of comparison from the comparator 106 are further sent to the indicator 112 for warning a user of the system 100.

For purposes of an example, with out limiting the scope of the invention described in the present Patent Application, dynamic chemical vapor concentration profiles, simulating the detector measurements, are provided in a concentration sequence Table 1 as stimulus to the system and method 100. For these dynamic vapor profiles, the system 100 determines, as a function of time, the hazard levels and the dosage for the sampled chemical agent.

The algorithm 10 associated with the system 100, described herein, uses the equation format generated by MATHCAD™ 6.0.

Although the algorithm 10 and the method of the present invention is perfectly applicable to any kind of chemical, biological and nuclear agent, for the purpose of the example, a chemical vapor GV is chosen to illustrate the work of the algorithm for determining hazard levels of the present invention. This chemical has the following single dose hazard levels, DL, measured in mg·min/m$^3$:

| | |
|---|---|
| None | DL < 0.05 |
| Low | 0.05 ≦ DL < 0.5 |
| Medium | 0.5 ≦ DL < 600 |
| High | DL ≧ 600 |

Figure 2A:
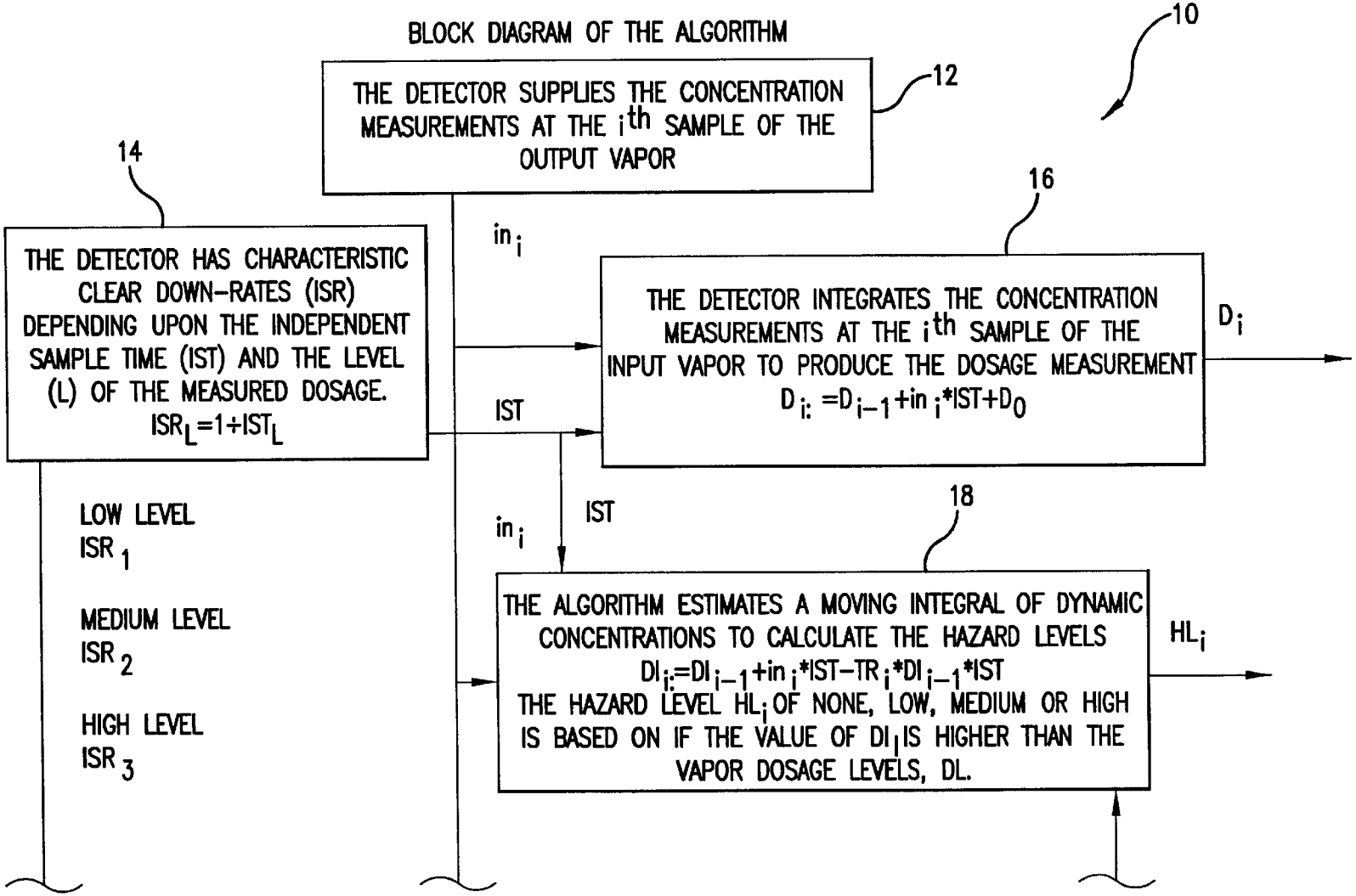
FIG. 2 is a flow chart showing a block diagram of the algorithm of the present invention.
Figure 2B:
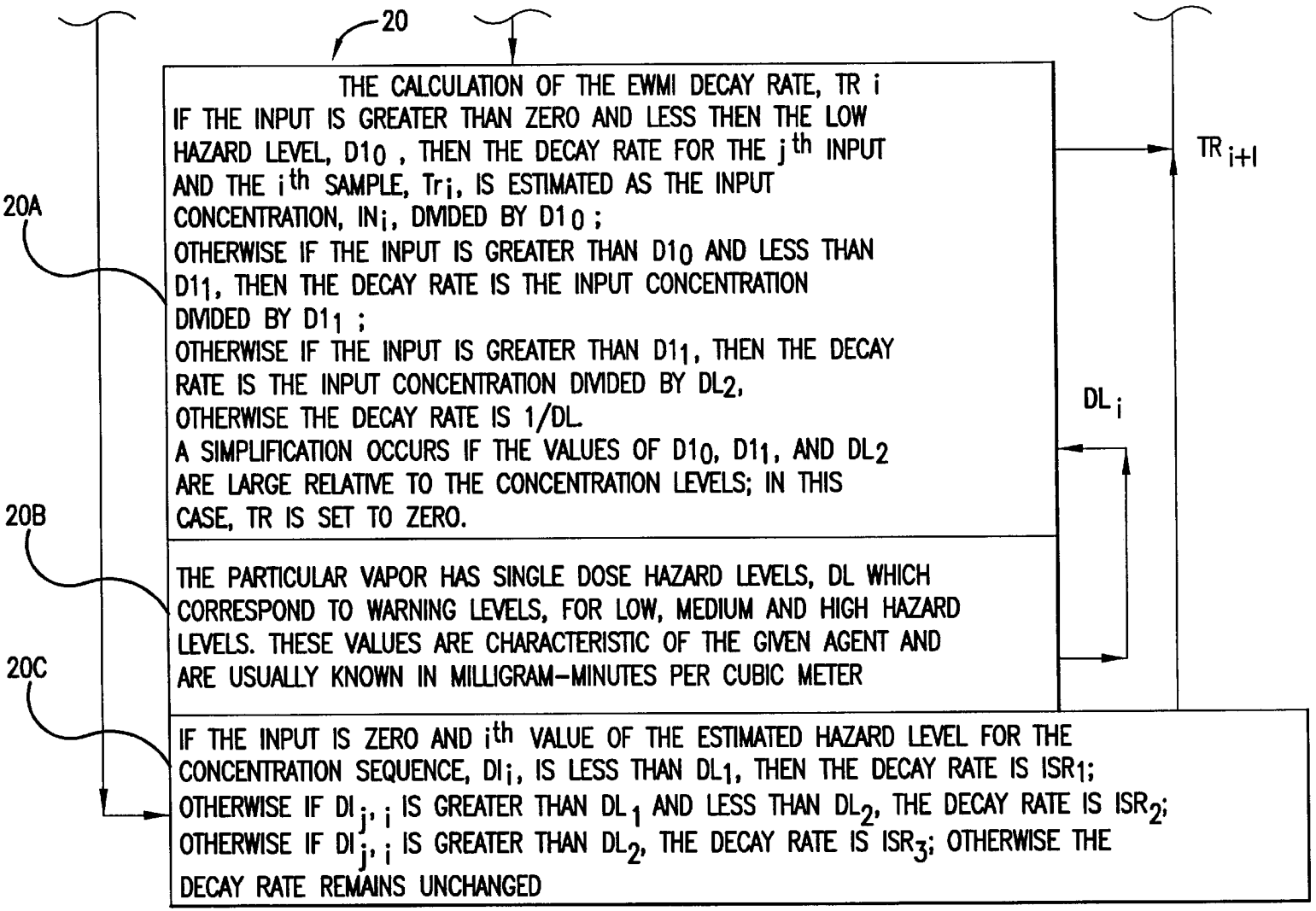
Figure 3:
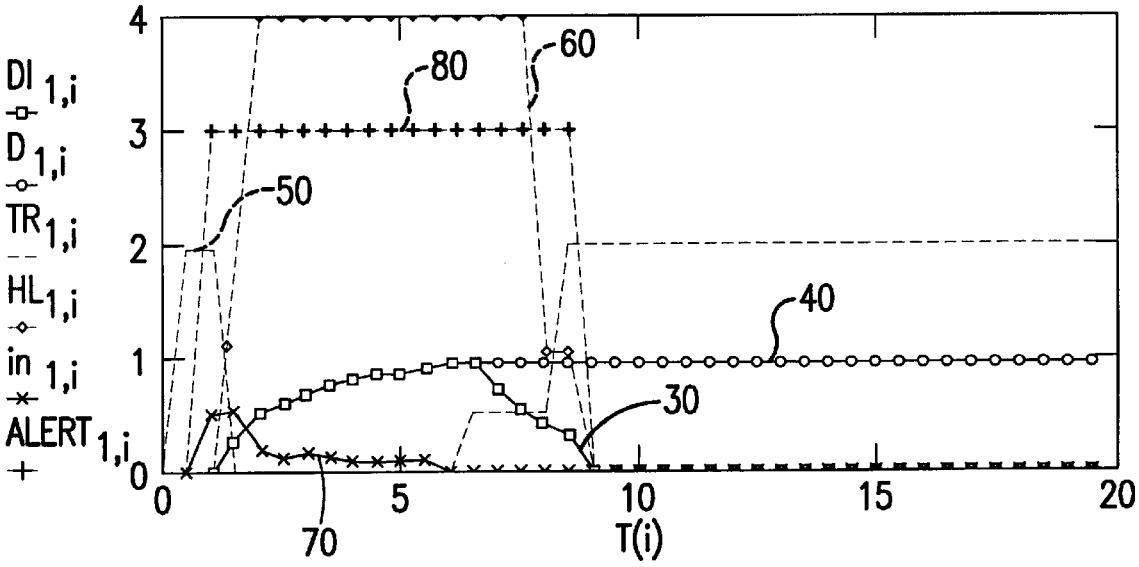
FIGS. 3–6 are diagrams demonstrating responses of the algorithm of the present invention to four input concentration sequences of Table 1.
Figure 4:
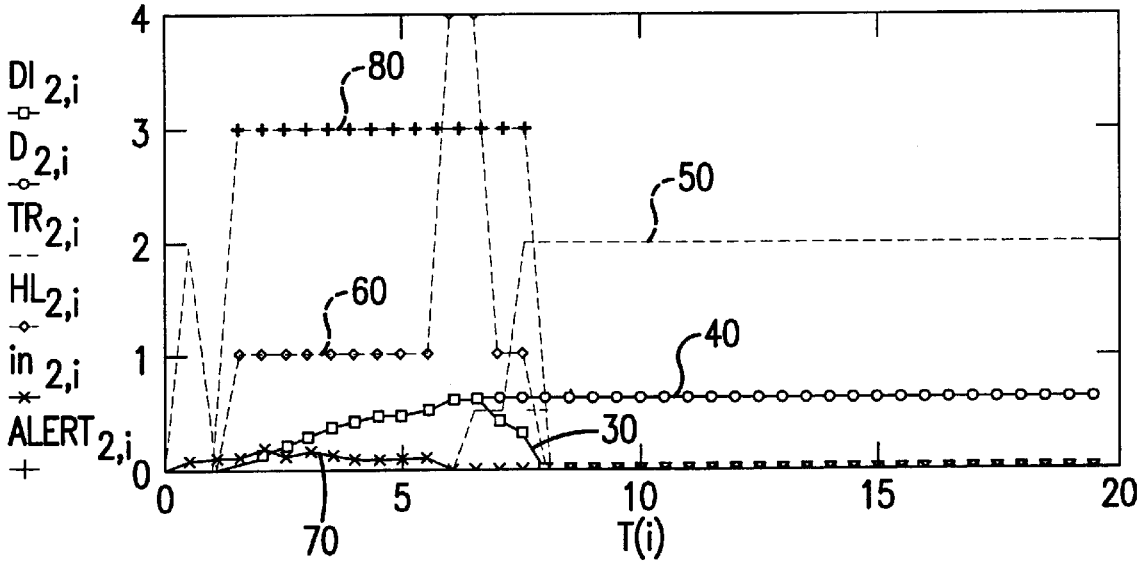
Figure 5:
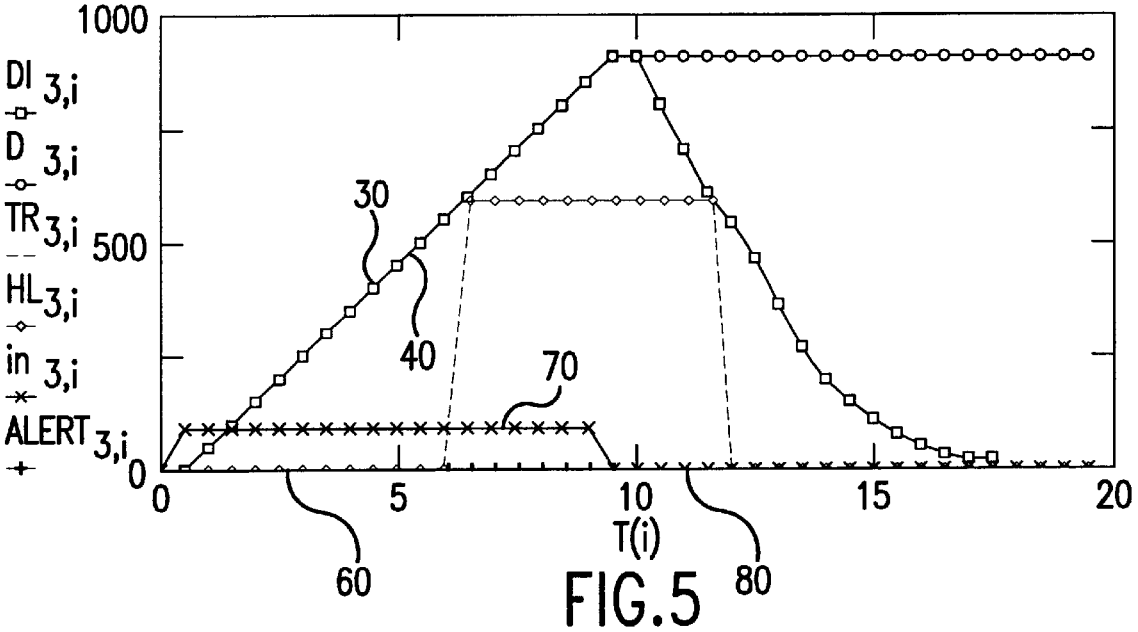
Figure 6:
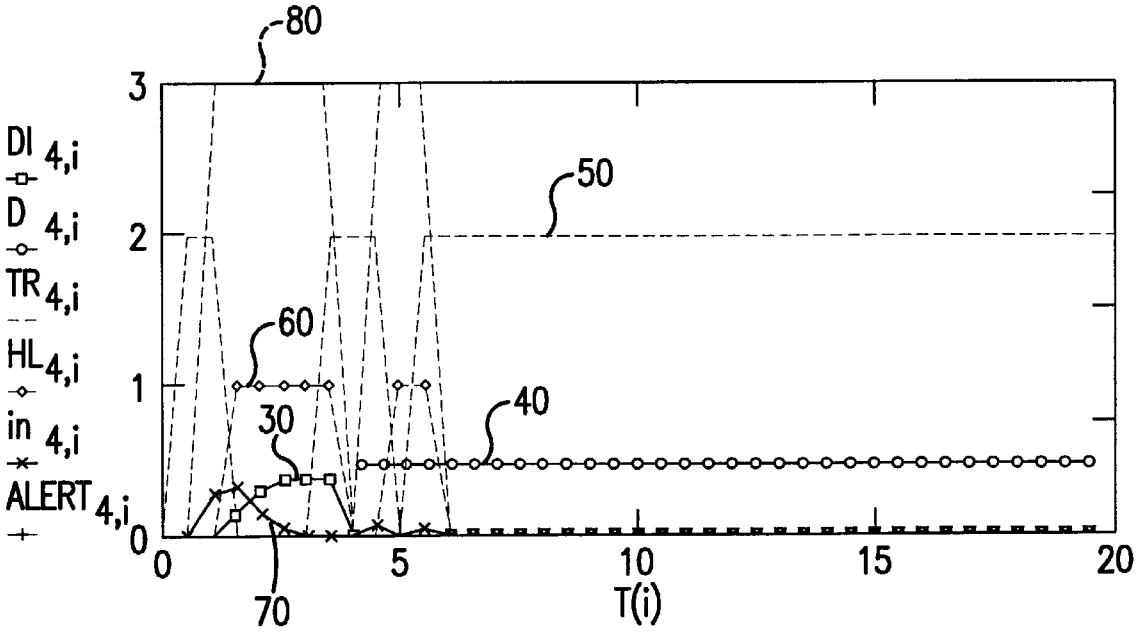

The block diagram of the algorithm 10 best shown in FIG. 2, is initiated with block 12 representing measured concentrations of the vapor in the environment. In this example, the logic block 12 supplies four input concentration sequences shown in the Table 1.

TABLE 1

| Input Concentration Sequence in mg/m$^3$ | | | |
|---|---|---|---|
| First Sequence | Second Sequence | Third Sequence | Fourth Sequence |
| $in_{1,1}$: = 0.00 | $in_{2,1}$: = 0.00 | $in_{3,1}$: = 0.00 | $in_{4,1}$: = 0.00 |
| $in_{1,2}$: = 0.00 | $in_{2,2}$: = 0.1 | $in_{3,2}$: = 102.4 | $in_{4,2}$: = 0.00 |
| $in_{1,3}$: = 0.49 | $in_{2,3}$: = 0.1 | $in_{3,3}$: = 102.4 | $in_{4,3}$: = 0.28 |
| $in_{1,4}$: = 0.52 | $in_{2,4}$: = 0.1 | $in_{3,4}$: = 102.4 | $in_{4,4}$: = 0.32 |
| $in_{1,5}$: = 0.19 | $in_{2,5}$: = 0.1 | $in_{3,5}$: = 102.4 | $in_{4,5}$: = 0.14 |
| $in_{1,6}$: = 0.19 | $in_{2,6}$: = 0.1 | $in_{3,5}$: = 102.4 | $in_{4,6}$: = 0.05 |
| $in_{1,7}$: = 0.19 | $in_{2,7}$: = 0.1 | $in_{3,7}$: = 102.4 | $in_{1,6}$: = 0.19 |
| $in_{1,8}$: = 0.19 | $in_{2,8}$: = 0.1 | $in_{3,8}$: = 102.4 | $in_{1,6}$: = 0.19 |
| $in_{1,9}$: = 0.08 | $in_{2,9}$: = 0.1 | $in_{3,9}$: = 102.4 | $in_{4,9}$: = 0.00 |
| $in_{1,10}$: = 0.08 | $in_{2,10}$: = 0.1 | $in_{3,10}$: = 102.4 | $in_{4,40}$: = 0.1 |
| $in_{1,11}$: = 0.08 | $in_{2,11}$: = 0.1 | $in_{3,11}$: = 102.4 | |
| $in_{1,12}$: = 0.08 | $in_{2,12}$: = 0.1 | $in_{3,12}$: = 102.4 | |
| | | $in_{3,13}$: = 102.4 | |
| | | $in_{3,14}$: = 102.4 | |
| | | $in_{3,15}$: = 102.4 | |
| | | $in_{3,16}$: = 102.4 | |
| | | $in_{3,17}$: = 102.4 | |
| | | $in_{3,18}$: = 102.4 | |
| | | $in_{3,19}$: = 102.4 | |

In Mathcad™ the symbol ":=" is read as "define as". Thus, the algorithm uses the following equations to define the above hazard levels:

$$DL_0:=0.05,\ DL_1:=0.5,\ DL_2:=600 \tag{2}$$

The above values are set to match the empirical data on hazard levels of GB presented in the equations (1).

The algorithm also sets the alert concentration threshold requirement, AT, for GB to be at 0.1 mg/M$^3$.

$$AT:=0.10 \tag{3}$$

In logic block 14, the independent sample time, IST, of each measurement, in minutes, is defined to the algorithm for each hazard level defined in the equation (2). At low concentration levels, the method assumes that the IST is limited by the detector sampling time. For the purpose of illustration, the system 100 assumes measurements are taken every 30 seconds. The system 100 further assumes the response of the detector does not significantly affect the independence of the measurements at low concentrations whereby in this example, the IST, is 0.5 minutes.

The independent sample rate, ISR, is the reciprocal of the time between independent samples. Then, for the low concentrations, $$IST_1 := .5,\ ISR_1 := \frac{1}{IST_1} \tag{4}$$

The method and system 100 permits detector clear down times (or decay rates) to vary. For example, if the hazard level is at the medium level, a longer decay time is expected.

For the purpose of this example, the system 100 defines that the example detector 102 has a clear down time of 2 minutes at the medium hazard level.

$$IST_2 := 2,\ ISR_2 := \frac{1}{IST_2} \tag{5}$$

Likewise, if the hazard level is high, the system 100 expects that the detector 102 may have longer decay rates. For the purpose of this example, the system 100 defines the decay time as 4 minutes at the high hazard level.

$$IST_3 := 4,\ ISR_3 := \frac{1}{IST_3} \tag{6}$$

The concentration measurements from the logic block 12 and the independent sample times, IST, from the logic block 14 are fed to the block 16, in which the algorithm 10 calculates the cumulative concentration (the dosage) $D_i$ at the $i^{th}$ sample according to the following equation:

$$D_i := D_{i-1} + in_i \cdot IST + D_0, \tag{7}$$

wherein:

$in_i$=the measurement of the $i^{th}$ sample of the input vapor;

$D_{i-1}$=the dosage at the last before the $i^{th}$ sample,

IST=the independent sample time, and $D_0$=the initial value of the dosage; normally $D_0$=0.

Further, the concentration measurements $in_i$ from the logic block 12 and the independent sample times, IST, from the logic block 14 are fed to the logic block 18, in which the system and method 100 estimates an exponentially weighted moving integral $DI_i$ of dynamic concentrations to calculate the hazard levels. This estimate of the moving integral is a sum of exponentially weighted values of the past concentrations. The equation for the EWMI, $DI_i$, is given by the following equation:

$$DI_i := DI_{i-1} + in_i \cdot IST - TRI * DI_{i-1} * IST, \tag{8}$$

wherein $DI_i$=the EWMI at the $i^{th}$ sample;

$DI_{i-1}$=the EWMI at the last before the $i^{th}$ sample;

$in_i$=the measurement of the $i^{th}$ sample of the input vapor,

IST=the independent sample time, and $TR_i$=the decay rate at the $i^{th}$ sample.

The decay rate controls the extent the previous samples of $in_i \cdot IST$ remain in the moving integral. If the IST and the $TR_i$ variables remain constant, and $TR_i$ is less than one, the samples are given progressively less weight as they become older.

It will be readily understood by those skilled in the art, that the EWMI is computationally efficient. The EWMI requires the storage of one value, $DI_{i-1}$, two multiplications, and two additions for each sampled time period. A moving integral, to the contrary, would require the storage of all concentrations, the integration time period, the addition of all concentrations during the integration time period, and multiplication by IST.

The concentration measurements $in_i$ from block 12 and the independent sample rates, ISR, from block 14 for each hazard level are fed to the block 20 in which the system and method 100 calculates the decay rate of the EWMI, $TR_i$ by estimating the time period that the current concentration would take to reach to the next higher predefined hazard level. Assuming the $i^{th}$ concentration level is denoted by $in_i$, then the time to integrate that concentration level and obtain the next higher hazard level is $DL/in_i$. The system 100 sets the decay rate, $TR_i$, to correspond to the inverse of this time period. In the portion 20 A of the logic block 20, the decay rate $TR_i$ is calculated in accordance with the following logical statements:

The Mathcad™ "if statement" uses the following process logic: "if this, then that, otherwise the following". Products within the "if statement" "this part" are processed as "logical ANDs", and "plus" signs are processed as "logical ORs". In the cases of nested "if statements", Mathcad follows the standard rules for processing embedded "if statements".

The Mathcad™ equation (g) is read as follows: if the input is greater than zero and less than the low hazard level, $DL_0$, then the decay rate for the $j^{th}$ input and the $i^{th}$ sample, $TR_{j,i}$, is estimated as the input concentration, $in_{i,j}$, divided by $DL_0$; otherwise if the input is greater than $DL_0$, and less than $DL_1$, then the decay rate is the input concentration divided by $DL_1$; otherwise, if the input is greater than $DL_1$, then the decay rate is the input concentration divided by $DL_2$, otherwise the decay rate is $1/DL_1$.

The decay rate, $TR_{j,\ i+1}$, is as follows:

$$\text{if}\left[(in_{j,i} > 0)\cdot(in_{j,i} < DL_0),\ \frac{in_{j,i}}{DL_0},\ \left[\text{if}\ [in_{j,i} > DL_0)\cdot(in_{j,i} < DL_1),\ \frac{in_{j,i}}{DL_1},\ \text{if}\left[(in_{j,i} > DL),\ \frac{in_{j,i}}{DL_2},\ \frac{1}{DL_1}\right]\right]\right] \tag{9}$$

A simplification occurs if the time to reach the next hazard level is large. Under this condition, the value of TR is zero. Thus, if the concentration is greater than zero, and the integration time is relatively long (>100 min), the value of the decay rate, TR is set to zero.

In the portion 20B of the block 20, the system 100 pre-sets single dose hazard levels, DL, which correspond to warning levels (low, medium, and high hazard levels) in accordance with the equation (2). Data $DL_i$ is fed from the block 20B to the block 20A for further processing in accordance with the above logical statements.

The relationship between the decay rates and discrete time series processing is known to those skilled in the art and may be found, for example, in R. G. Brown: "Smoothing, Forecasting, and Prediction of Discrete Time Series", Prentice Hall, 1964.

In the block 20C, the logic calculates the decay rate in accordance with the following logical statements:

- when the input goes to zero, the decay rate of the estimated hazard level depends on the detector's predefined decay rates. Equation (10) is to be read as follows: if the input is zero and $i^{th}$ value of the estimated hazard level for the $j^{th}$ input concentration sequence, $DI_{j,i}$, is less than $DL_1$, then the decay rate is $ISR_1$;
- otherwise if the input is zero, and $DI_{j,i}$ is greater than $DL_1$ and less than $DL_2$, the decay rate is $ISR_2$;
- otherwise if the input is zero, and $DI_{j,1}$ is greater than $DL_2$, the decay rate is $ISR_3$;
- otherwise the decay rate remains unchanged from the decay rate calculated by the equation in the previous paragraph.

$$\text{if}\ [(in_{j,i}=0)\cdot(DI_{j,i}<DL_1),\ ISR_1,\ \text{if}\ [(in_{j,i}=0)\cdot(DI_{j,i}<DL_1)\cdot(DI_{j,i}<DL_2),\ ISR_2,\ \text{if}\ [(in_{j,i}=0)\cdot(DI_{j,i}>DL_2),\ ISR_3,\ TR_{j,i+1}]]] \tag{10}$$

Data corresponding to the decay rates are fed from the block 20 (20A and 20C) to the logic block 18, where they are further processed.

In the method and system 100, the initial condition for $DI_{j,0}$, $TR_{j,0}$ and $D_{j,0}$ must be initialized. Also, Mathcad™ needs to extend the range of all the data arrays by one to prevent Mathcad™ from detecting data array range errors. In this Mathcad™ simulation of the method 100, the variable IMAX, is the upper limit of the number of samples.

$$DI_{j,0}:=0,\ DI_{j,IMAX+1}:=DI_{j,IMAX}$$

$$TR_{j,0}:=DL_1,\ TR_{j,IMAX+1}:=TR_{j,IMAX}$$

$$D_{j,0}:=0,\ D_{j,IMAX+1}:=D_{j,IMAX} \tag{11}$$

The algorithm's 10 equations must be processed in a predetermined order. The following matrix of equations controls the order of the solution within Mathcad™. First, the right hand side of the matrix (12) of equations is evaluated from top to bottom and then values are assigned to the left hand side of the matrix. In the following equation, SPM is the inverse of IST.

$$\begin{bmatrix} D_{j,i+1} \\ TR_{j,i+1} \\ TR_{j,i+1} \\ DL_{j,i+1} \end{bmatrix} := \begin{bmatrix} D_{j,i} + \dfrac{in_{j,i}}{SPM} \\ \text{if}\ \left[(in_{j,i} > 0)\cdot(in_{j,i} < DL_0),\ \dfrac{in_{j,i}}{DL_0},\ \text{if}\ \left[(in_{j,i} > DL_0)\cdot(in_{j,i} < DL_1),\ \dfrac{in_{j,i}}{DL_1},\ \text{if}\ \left[(in_{j,i} > DL_1),\ \dfrac{in_{j,i}}{DL_2},\ \dfrac{1}{DL_1}\right]\right]\right] \\ \text{if}\ [(in_{j,i} = 0)\cdot(DI_{j,i} < DL_1),\ ISR_1,\ \text{if}\ [(in_{j,i} = 0)\cdot(DI_{j,i} > DL_1)\cdot(DI_{j,i} < DL_2),\ ISR_2,\ \text{if}\ [(in_{j,i} = 0)\cdot(DI_{j,i} > DL_2),\ ISR_3,\ TR_{j,i+1}] \\ \left(DL_{j,i} + \dfrac{in_{j,i} - TR_{j,i}\cdot DL_{j,i}}{SPM}\right) \end{bmatrix} \tag{12}$$

In order to provide a plot when the method generates the hazard levels of none, low, medium, and high, the following equation (13) assigns the values of 0, 1, 4, and 600, respectively for the hazard level, $HL_{j,i}$.

$$HL_{j,i}:=\text{if}\ [DI_{j,i}<DL_0,\ 0,\ \text{if}\ [DI_{j,i}>DL_0)\cdot(DI_{j,i}<DL_1),\ 1,\ \text{if}\ [(DI_{j,i}>DL_1)\cdot(DI_{j,i}<DL_2),4,\ \text{if}\ [(DI_{j,i}>DL_2,600,0)]]] \tag{13}$$

In order to provide a plot when this method generates an alert, the following equation (14) assigns a value of 3 if either the input concentration is higher than AT or the calculated hazard level matches or exceeds the predefined low hazard level.

$$ALERT_{j,i}:=\text{if}\ [(in_{j,i}>AT)+(HL_{j,i}\geqq 1.0),3,0] \tag{14}$$

The demonstration example of the system and method 100 begins by creating a set of input sample sequences of GB concentrations as a function of time.

The method 100 assumes the input sequence be represented by $in_{i,j}$ for the $j^{th}$ input, and the $i^{th}$ sample sequence number representing samples every 30 seconds.

The method 100 further assumes that the sequence of samples starts at one and is incremented by one to some maximum value of i, IMAX. Also, since the samples occur every 30 seconds, there are two samples per minute. Assuming a 20 minute test duration, there would be 40 samples for each test.

$$IMAX:=40 \tag{15}$$

Four input sequences are generated by first setting all values to zero and then setting up the input sequences to match the data in the Table 1.

$$i=1,2\ldots IMAX,\ j:=1,2\ldots 4 \tag{16}$$

$$in_{j,i}:=0,\ in_{j,i+1}:=in_{j,i} \tag{17}$$

The sequences shown in Table 1 were constructed to demonstrate the behavior of the algorithm 10. The first sequence is a set of dynamic concentrations that generate a "low" and then a "medium" hazard level followed by a decay from a "medium" hazard level to "none". The second sequence is a fixed duration sequence of constant concentration. It is a single pulse that generates a "low" hazard level then a "medium" hazard level followed by a decay from "medium" to "none". The third sequence is also a fixed duration sequence of constant concentration. It is a single pulse that generates a "high hazard" level followed by a decay from "high" to "none". This third example visually demonstrates the concept of exponential decay. The fourth sequence is a set of dynamic concentrations that generate the "low" hazard level that decays to "zero" and then generates another concentration at a "low" hazard level that also decays to "zero".

FIGS. 3–6 represent diagrams showing DI, D, TR, HL, IN, and ALERT for four sequences of the concentrations of Table 1. In FIGS. 3–6, T(i) is a time related variable which vary from 0.5 to [IMAX÷2]–0.50, and follows the equation:

$$T(i) := \frac{i}{SPM}0.5 \tag{18}$$

wherein SPM is the inverse of the IST.

As can be seen in FIGS. 3–6, the diagram of $D_i$ $I_i$ is function of $T_i$ is denoted as 30, the diagram of $D_{ji}$ is denoted as 40, the diagram of $TR_{ji}$ is denoted as 50, the diagram of $HL_{ji}$ is denoted as 60, the diagram of $IN_{ji}$ is denoted as 70, and the diagram of $ALERT_{ji}$ is denoted as 80. It can be seen that the ALERT diagram 80, extends at the areas where the diagram $DI_{ji}$ 30 matches or exceeds the diagram $D_{ji}$ 40.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A method of determining hazard levels of a vapor in an environment, comprising the steps of:

(a) measuring concentrations of said vapor in said environment;

(b) estimating hazard level values of said vapor in said environment by applying an exponentially weighted moving integration to said measured concentrations;

(c) predetermining hazard dosage values;

(d) comparing said estimated hazard level values to said predetermined hazard dosage values;

(e) generating an indication of the level of hazard when said estimated hazard level values substantially match said predetermined hazard dosage values; and, (f) calculating a cumulative dosage by integrating said measured concentrations of said vapor according to:

$$D_i = D_{i-1} + in_i \cdot IST + D_0$$

wherein $D_i$=the cumulative dosage at the $i^{th}$ sample, $in_i$=the measured concentration at the $i^{th}$ sample, IST=the dependent sample time, and $D_0$=the initial value of the dosage.

2. The method of claim 1, further including the steps of:

predetermining a low hazard dosage value, a medium hazard dosage value, and a high hazard dosage value.

3. The method of claim 2, further including the steps of:

defining a respective independent sample time for each of said predetermined hazard dosage values.

4. A method of determining hazard levels of a vapor in an environment, comprising the steps of:

(a) measuring concentrations of said vapor in said environment, (b) estimating hazard level values of said vapor in said environment by applying an exponentially weighted moving integration to said measured concentrations, said estimated hazard level values being calculated according to:

$$DI_i = DI_{i-1} + in_i \cdot IST - TR_i \cdot DI_{i-1} \cdot IST,$$

wherein $DI_i$=the exponentially weighed moving integral at the $i^{th}$ sample, $DI_{i-1}$=the exponentially weighted moving integral previous to the $i^{th}$ sample, $in_i$=the measured concentration at the $i^{th}$ sample, IST=the independent sample time, and $TR_i$=the $i^{th}$ decay rate, (c) predetermining hazard dosage values, (d) comparing said estimated hazard level values to said predetermined hazard dosage values, and (e) generating an indication of the level of hazard when said estimated hazard level values substantially match said predetermined hazard dosage values.

5. The method of claim 4, wherein said decay rate $TR_i$ is calculated by estimating the time period necessary for a measured concentration to reach a next higher predetermined hazard dosage value.

6. The method of claim 5, wherein said decay rate $TR_i$ is substantially zero when said concentration is greater than zero and said time period necessary for said measured concentration to reach a next higher predetermined hazard dosage value is larger than 100 minutes.

* * * * *